US010621912B2

(12) United States Patent
Park et al.

(10) Patent No.: US 10,621,912 B2
(45) Date of Patent: Apr. 14, 2020

(54) DISPLAY DEVICE TO DISPLAY IMAGES ON REAR AND FRONT SURFACES INDEPENDENTLY OF EACH OTHER

(71) Applicant: Samsung Display Co., LTD., Yongin-si, Gyeonggi-Do (KR)

(72) Inventors: Jong-hyun Park, Cheongju-si (KR); Seongkweon Heo, Suwon-si (KR)

(73) Assignee: SAMSUNG DISPLAY CO., LTD., Gyeonggi-Do (KR)

( * ) Notice: Subject to any disclaimer, the term of this patent is extended or adjusted under 35 U.S.C. 154(b) by 136 days.

(21) Appl. No.: 15/040,294

(22) Filed: Feb. 10, 2016

(65) Prior Publication Data

US 2016/0293108 A1 Oct. 6, 2016

(30) Foreign Application Priority Data

Apr. 6, 2015 (KR) ..... 10-2015-0048550

(51) Int. Cl.
*G09G 3/30* (2006.01)
*G09G 3/36* (2006.01)
*G09G 3/3233* (2016.01)

(52) U.S. Cl.
CPC ..... *G09G 3/3233* (2013.01); *G09G 2300/023* (2013.01); *G09G 2300/0842* (2013.01)

(58) Field of Classification Search
CPC ..... G09G 5/14; G09G 2300/023; G09G 2300/026; G09G 2300/0413
See application file for complete search history.

(56) References Cited

U.S. PATENT DOCUMENTS

2005/0151830 A1* 7/2005 Yamazaki ..... G09G 3/20 347/238
2006/0066229 A1* 3/2006 Nimura ..... H01L 27/3267 313/506
2009/0128020 A1* 5/2009 Takei ..... H01L 27/3223 313/504
2013/0314647 A1* 11/2013 Yim ..... G02F 1/133528 349/69
2014/0042403 A1* 2/2014 Lee ..... H01L 51/448 257/40
2014/0132490 A1 5/2014 Zhang et al.

FOREIGN PATENT DOCUMENTS

JP 2006523003 A 10/2006
KR 100685844 B1 2/2007
KR 100707605 B1 4/2007
KR 1020080089793 A 10/2008
KR 101084198 B1 11/2011
KR 1020140036928 A 3/2014

* cited by examiner

*Primary Examiner* — Sanghyuk Park
(74) *Attorney, Agent, or Firm* — Cantor Colburn LLP

(57) ABSTRACT

A display device includes first pixels which displays a front image, second pixels which displays a rear image, scan lines extending in a first direction and connected to the first and second pixels, and data lines extending in a second direction crossing the first direction and connected to the first and second pixels. The data lines extend via the second pixels.

19 Claims, 5 Drawing Sheets

DISPLAY DEVICE TO DISPLAY IMAGES ON REAR AND FRONT SURFACES INDEPENDENTLY OF EACH OTHER

This application claims priority to Korean Patent Application No. 10-2015-0048550, filed on Apr. 6, 2015, and all the benefits accruing therefrom under 35 U.S.C. § 119, the content of which in its entirety is herein incorporated by reference.

BACKGROUND

1. Field

The disclosure relates to a display device. More particularly, the disclosure relates to a display device that displays images on front and rear sides thereof.

2. Description of the Related Art

In recent years, various display devices, such as a liquid crystal display device, an organic light emitting display device, an electrowetting display device, a plasma display panel, an electrophoretic display device, etc., have been developed.

Among them, the organic light emitting display device displays the image using an organic light emitting element that emits light by recombination of electrons and holes. The organic light emitting display device may not include a separate light source and has desirable characteristics, including high brightness, wide viewing angle, fast response time and low power consumption, for example.

The organic light emitting display device may be classified into one of a front light emitting type and a rear light emitting type. In recent years, however, an organic light emitting display device may substantially simultaneously perform both front light emission and rear light emission.

SUMMARY

The disclosure provides a display device that displays images on rear and front surfaces, independently of each other.

Embodiments of the inventive concept provide a display device including a plurality of first pixels which displays a front image, a plurality of second pixels which displays a rear image, a plurality of scan lines extending in a first direction and connected to the first and second pixels, and a plurality of data lines extending in a second direction crossing the first direction and connected to the first and second pixels. In such embodiments, the data lines overlap the second pixels.

In an embodiment, each of the first pixels may include a first pixel area on which the front image is displayed, each of the second pixels may include a second pixel area, on which the rear image is displayed, and the data lines may extend via the second pixel area.

In an embodiment, the scan lines may include a plurality of first scan lines connected to the first pixels and a plurality of second scan lines connected to the second pixels. In such an embodiment, the data lines may include a plurality of first data lines connected to the first pixels and a plurality of second data lines connected to the second pixels.

In an embodiment, the first pixels may be alternately arranged with the second pixels in the first direction and the first, and second pixels may be arranged in the second direction.

In an embodiment, the first and second pixels may be arranged substantially in a matrix form, each of the first scan lines may be disposed at a upper portion of the first pixels arranged in a corresponding row and connected to the first pixels arranged in the corresponding row, and each of the second scan lines may be disposed at a lower portion of the second pixels arranged in the corresponding row and connected to the second pixels arranged in the corresponding row.

In an embodiment, each of the first pixels may include a first switching element including a control terminal connected to a corresponding first scan line of the first scan lines, an input terminal connected to a corresponding first data line of the first data lines, and an output terminal, a first driving element including a control terminal connected to the output terminal of the first switching element, an input terminal connected to a power line, and an output terminal, and a first light emitting diode disposed in a first pixel area, which is a pixel area of the first pixels, and driven by the first driving element.

In an embodiment, each of the second pixels may include a second switching element including a control terminal connected to a corresponding second scan line of the second scan lines, an input terminal connected to a corresponding second data line of the second data lines, and an output terminal, a second driving element including a control terminal connected to the output terminal of the second switching element, an input terminal connected to the power line, and an output terminal, and a second light emitting diode disposed in a second pixel area, which is a pixel area of the second pixel, and driven by the second driving element.

In an embodiment, the first and second data lines and the power line may extend in the second direction via the second pixel area.

In an embodiment, the first and second driving elements and the first and second switching elements may be disposed to overlap the second pixel area.

In an embodiment, the first light emitting diode may include a first pixel electrode connected to the output terminal of the first driving element, a first organic light emitting layer disposed on the first pixel electrode, a common electrode disposed on the first organic light emitting layer, and a dummy electrode disposed on the first organic light emitting layer. In such an embodiment, the second light emitting diode may include a second pixel electrode connected to the output terminal of the second driving element, a second organic light emitting layer disposed on the second pixel electrode, and a common electrode disposed on the second organic light emitting layer.

In an embodiment, the first pixel electrode may be a transparent electrode including a transparent conductive material.

In an embodiment, the second pixel electrode may be a reflective electrode including a metal.

In an embodiment, the common electrode and the dummy electrode of the first and second light emitting diodes may include a metal.

In an embodiment, the first and second data lines and the power line may extend via the second organic light emitting layer, and the first and second driving elements and the first and second switching elements may be disposed to overlap the second organic light emitting layer.

In an embodiment, the display device further includes a substrate on which the first and second driving elements are disposed, an insulating layer disposed on the substrate to cover the first and second driving elements except for the first pixel area, where a first opening corresponding to the first pixel area is defined through the insulating layer, and a pixel definition layer disposed on the insulating layer, where the first opening and a second opening corresponding to the second pixel area are defined through the pixel definition layer. In such an embodiment, the first pixel electrode may be disposed on the substrate, the second pixel electrode may be disposed on the insulating layer, the first opening may expose a predetermined area of the first pixel electrode, and the second opening may expose a predetermined area of the second pixel electrode.

In an embodiment, the output terminal of the first driving element may extend to make contact with a lower surface of the predetermined area of the first pixel electrode, which is not overlapped with the first pixel area, and the output terminal of the second driving element may be connected to the second pixel electrode through a contact hole defined through the insulating layer.

In an embodiment, the display device further includes a first scan driver which applies first scan signals to the first pixels through the scan lines, a second scan driver which applies second scan signals to the second pixels through the scan lines, a first data driver which applies first data voltages to the first pixels through the data lines, and a second data driver which applies second data voltages to the second pixels through the data lines.

In an embodiment, the first pixels may receive the first data voltages in response to the first scan signals and display the rear image using the first data voltages.

In an embodiment, the second pixels may receive the second data voltages in response to the second scan signals and display the front image using the second data voltages.

In an embodiment, the first and second pixels are arranged substantially in a matrix form, the first pixels may be alternately arranged with the second pixels in the second direction, the first and second pixels may be arranged in the first direction, and each of the first scan lines and each of the second scan lines are disposed between the first pixels arranged in a corresponding row and the second pixels arranged in a next row of the corresponding row.

According to embodiments of the invention, the display device may display individual images on the rear and front surfaces, respectively.

BRIEF DESCRIPTION OF THE DRAWINGS

The above and other features of the invention will become readily apparent by reference to the following detailed description when considered in conjunction with the accompanying drawings, in which.

DETAILED DESCRIPTION

Figure 1:
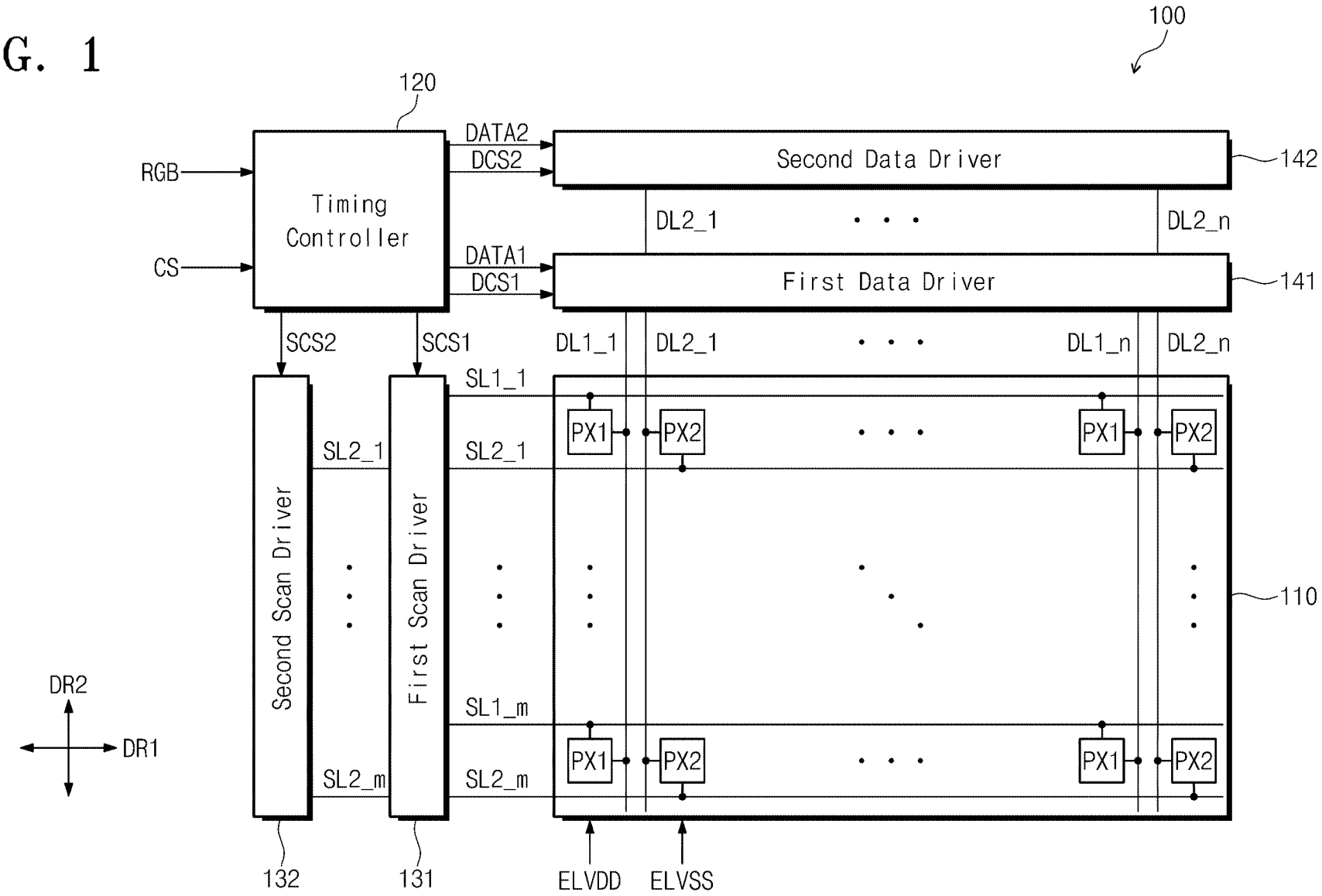
FIG. 1 is a block diagram showing an exemplary embodiment of a display device according to the invention.

The invention now will be described more fully hereinafter with reference to the accompanying drawings, in which various embodiments are shown. This invention may, however, be embodied in many different forms, and should not be construed as limited to the embodiments set forth herein. Rather, these embodiments are provided so that this disclosure will be thorough and complete, and will fully convey the scope of the invention to those skilled in the art. Like reference numerals refer to like elements throughout.

It will be understood that when an element or layer is referred to as being "on", "connected to" or "coupled to" another element or layer, it can be directly on, connected or coupled to the other element or layer or intervening elements or layers may be present. In contrast, when an element is referred to as being "directly on," "directly connected to" or "directly coupled to" another element or layer, there are no intervening elements or layers present. Like numbers refer to like elements throughout. As used herein, the term "and/or" includes any and all combinations of one or more of the associated listed items.

It will be understood that, although the terms first, second, etc. may be used herein to describe various elements, components, regions, layers and/or sections, these elements, components, regions, layers and/or sections should not be limited by these terms. These terms are only used to distinguish one element, component, region, layer or section from another region, layer or section. Thus, a first element, component, region, layer or section discussed below could be termed a second element, component, region, layer or section without departing from the teachings of the invention.

Spatially relative terms, such as "beneath", "below", "lower", "above", "upper" and the like, may be used herein for ease of description to describe one element or feature's relationship to another element(s) or feature(s) as illustrated in the figures. It will be understood that the spatially relative terms are intended to encompass different orientations of the device in use or operation in addition to the orientation depicted in the figures. For example, if the device in the figures is turned over, elements described as "below" or "beneath" other elements or features would then be oriented "above" the other elements or features. Thus, the exemplary term "below" can encompass both an orientation of above and below. The device may be otherwise oriented (rotated 90 degrees or at other orientations) and the spatially relative descriptors used herein interpreted accordingly.

The terminology used herein is for the purpose of describing particular embodiments only and is not intended to be limiting of the invention. As used herein, the singular forms, "a", "an" and "the" are intended to include the plural forms as well, unless the context clearly indicates otherwise. "Or" means "and/or." As used herein, the term "and/or" includes any and all combinations of one or more of the associated listed items. It will be further understood that the terms "comprises" and/or "comprising," or "includes" and/or "including", when used in this specification, specify the presence of stated features, integers, steps, operations, elements, and/or components, but do not preclude the presence or addition of one or more other features, integers, steps, operations, elements, components, and/or groups thereof.

"About" or "approximately" as used herein is inclusive of the stated value and means within an acceptable range of deviation for the particular value as determined by one of ordinary skill in the art, considering the measurement in question and the error associated with measurement of the particular quantity (i.e., the limitations of the measurement system). For example, "about" can mean within one or more standard deviations, or within ±30%, 20%, 10%, 5% of the stated value.

Unless otherwise defined, all terms (including technical and scientific terms) used herein have the same meaning as commonly understood by one of ordinary skill in the art to which this invention belongs. It will be further understood that terms, such as those defined in commonly used dictionaries, should be interpreted as having a meaning that is consistent with their meaning in the context of the relevant art and will not be interpreted in an idealized or overly formal sense unless expressly so defined herein.

Hereinafter, exemplary embodiments of the invention will be described in detail with reference to the accompanying drawings.

FIG. 1 is a block diagram showing an exemplary embodiment of a display device 100 according to the disclosure.

Referring to FIG. 1, an exemplary embodiment of the display device 100 includes a display panel 110, a timing controller 120, first and second scan drivers 131 and 132, and first and second data drivers 141 and 142.

The display panel 110 includes a plurality of pixels PX1 and PX2, a plurality of scan lines S1_1 to S1_*m* and S2_1 to S2_*m*, and a plurality of data lines D1_1 to D1_*n* and D2_1 to D2_*n*.

The pixels PX1 and PX2 are arranged substantially in a matrix form. The pixels PX1 and PX2 are connected to the scan lines S1_1 to S1_*m* and S2_1 to S2_*m*, and the data lines D1_1 to D1_*n* and D2_1 to D2_*n* crossing the scan lines S1_1 to S1_*m*. Here, n and m are natural numbers.

The pixels PX1 and PX2 include a plurality of first pixels PX1 and a plurality of second pixels PX2. The first pixels PX1 display a first image on a rear surface of the display panel 110. The second pixels PX2 display a second image on a front surface of the display panel 110.

The first pixels PX1 are alternately arranged with the second pixels PX2 in a first direction DR1, e.g., a pixel row direction. The first pixels PX1 are arranged in a second direction DR2 and the second pixels PX2 are arranged in the second direction DR2, e.g., a pixel column direction.

However, in an exemplary embodiment, the arrangements of the first and second pixels PX1 and PX2 are not limited thereto or thereby. In an alternative exemplary embodiment, the first pixels PX1 may be alternately arranged with the second pixels PX2 in the second direction DR2. In such an embodiment, the first pixels PX1 are arranged in the first direction, and the second pixels PX2 are arranged in the first direction.

The scan lines S1_1 to S1_*m* and S2_1 to S2_*m* extend in the first direction DR1 and are connected to the first and second pixels PX1 and PX2. In such an embodiment, the first direction DR1 may be, but not limited to, the pixel row direction.

The scan lines S1_1 to S1_*m* and S2_1 to S2_*m* include a plurality of first scan lines S1_1 to S1_*m* and a plurality of second scan lines S2_1 to S2_*m*. The first scan lines S1_1 to S1_*m* extend in the first direction DR1 and are connected to the first pixels PX1, and the second scan lines S2_1 to S2_*m* extend in the first direction DR1 and are connected to the second pixels PX2.

Each of the first scan lines S1_1 to S1_*m*, e.g., an h-th first scan line S1_*h*, is disposed at an upper portion of the first pixels PX1 arranged in a corresponding row, e.g., an h-th row, among the first pixels PX1 arranged in a plurality of rows, and each of the first scan lines S1_1 to S1_*m*, e.g., the h-th first scan line S1_*h*, is connected to the first pixels PX1 arranged in the corresponding row, e.g., the h-th row. Herein, "h" is a natural number.

Each of the second scan lines S2_1 to S2_*m*, e.g., an h-th second scan line S2_*h*, is disposed at a lower portion of the second pixels PX2 arranged in the corresponding row, e.g., the h-th row, among the second pixels PX2 arranged in the rows, and each of the second scan lines S2_1 to S2_*m*, e.g., the h-th second scan line S2_*h*, is connected to the second pixels PX2 arranged in the corresponding row, e.g., the h-th row.

Although not shown in FIG. 1, in an alternative exemplary embodiment, where the first pixels PX1 are alternately arranged with the second pixels PX2 in the second direction DR2, each of the first scan lines S1_1 to S1_*m* and each of the second scan lines S2_1 to S2_*m* are disposed between the first pixels PX1 arranged in the corresponding row, e.g., h-th row, and the second pixels PX2 arranged in a next row of the corresponding row, e.g., a (h+1)-th row. In an exemplary embodiment, each of the first scan lines S1_1 to S1_*m*, e.g., the h-th first scan line S1_*h*, is connected to the first pixels PX1 arranged in the corresponding row, e.g., the h-th row, and each of the second scan lines S2_1 to S2_*m*, e.g., the h-th second scan line S2_*h*, is connected to the second pixels PX2 arranged in the next row of the corresponding row, e.g., the (h+1)-th row.

In an exemplary embodiment, the data lines D1_1 to D1_*n* and D2_1 to D2_*n* extend in the second direction DR2 crossing the first direction DR1 and are connected to the first and second pixels PX1 and PX2. The second direction DR2 may be, but not limited to, the pixel column direction.

The data lines D1_1 to D1_*n* and D2_1 to D2_*n* include a plurality of first data lines D1_1 to D1_*n* and a plurality of second data lines D2_1 to D2_*n*. The first data lines D1_1 to D1_*n* extend in the second direction DR2 and are connected to the first pixels PX1, and the second data lines D2_1 to D2_*n* extend in the second direction DR2 and are connected to the second pixels PX2.

Each of the first data lines D1_1 to D1_*n*, e.g., a k-th first data line D1_*k*, is connected to the first pixels PX1 arranged in a corresponding column, e.g., a k-th column, among the first pixels PX1 arranged in a plurality of columns. Each of the second data lines D2_1 to D2_*n*, e.g., a k-th second data line D2_*k*, is connected to the second pixels PX2 arranged in a corresponding column, e.g., a (k+1)-th column, among the second pixels PX2 arranged in the columns. In such an embodiment, a pair of the first and second data lines is disposed between the first pixels PX1 arranged in the k-th column and the second pixels PX2 arranged in the (k+1)-th column and connected to the first and second pixels PX1 and PX2. Here, "k" is a natural number.

Although not shown in FIG. 1, in an alternative exemplary embodiment, where the first pixels PX1 are alternately arranged with the second pixels PX2 in the second direction DR2, a pair of the first and second data lines is disposed between the first and second pixels PX1 and PX2 arranged in the corresponding column, e.g., the k-th column, and between the first and second pixels PX1 and PX2 arranged in the next column of the corresponding column, e.g., the (k+1)-th column, and the pair of the first and second data lines is connected to the first and second pixels PX1 and PX2.

The timing controller 120 receives image signals RGB and control signals CS from an external source, e.g., a system board. The image signals RGB include first image signals to display a rear image and second image signals to display a front image. The first image signals are substantially the same as or different from the second image signals.

The timing controller 120 converts a data format of the image signals RGB to a data format corresponding to (e.g., compatible with) an interface between the timing controller 120 and the first and second data drivers 141 and 142 to generate image signals DATA1 and DATA2. The timing controller 120 applies the image signals DATA1 and DATA2 having the converted data format to the first and second data drivers 141 and 142.

The image signals DATA1 and DATA2 include first image data DATA1 obtained by converting the data format of the first image signals and second image data DATA2 obtained by converting the data format of the second image signals. The first image data DATA1 are applied to the first data driver 141, and the second image data DATA2 are applied to the second data driver 142.

The timing controller 120 generates first and second scan control signals SCS1 and SCS2, and first and second data control signals DCS1 and DCS2, in response to the control signals CS.

The first scan control signal SCS1 controls an operation, e.g., an operation timing, of the first scan driver 131. The second scan control signal SCS2 controls an operation, e.g., an operation timing, of the second scan driver 132. The timing controller 120 applies the first scan control signal SCS1 to the first scan driver 131 and applies the second scan control signal SCS2 to the second scan driver 132.

The first data control signal DCS1 controls an operation, e.g., an operation timing, of the first data driver 141, and the second data control signal DCS2 controls an operation, e.g., an operation timing, of the second data driver 142. The timing controller 120 applies the first data control signal DCS1 to the first data driver 141 and applies the second data signal DCS2 to the second data driver 142.

The first scan driver 131 is connected to the first scan lines SL1_1 to SL1_*m*. The first scan driver 131 generates first scan signals in response to the first scan control signal SCS1. The first scan signals are sequentially output from the first scan driver 131. The first scan signals are applied to the first pixels PX1 through the first scan lines SL1_1 to SL1_*m*.

The second scan driver 132 is connected to the second scan lines SL2_1 to SL2_*m*. The second scan driver 132 generates second scan signals in response to the second scan control signal SCS2. The second scan signals are sequentially output from the second scan driver 132. The second scan signals are applied to the second pixels PX2 through the second scan lines SL2_1 to SL2_*m*.

The first data driver 141 is connected to the first data lines DL1_1 to DL1_*n*. The first data driver 141 generates first data voltages corresponding to the first image data DATA1 in response to the first data control signal DCS1. The first data voltages are applied to the first pixels PX1 through the first data lines DL1_1 to DL1_*n*.

The second data driver 142 is connected to the second data lines DL2_1 to DL2_*n*. The second data driver 142 generates second data voltages corresponding to the second image data DATA2 in response to the second data control signal DCS2. The second data voltages are applied to the second pixels PX2 through the second data lines DL2_1 to DL2_*n*.

The first and second pixels PX1 and PX2 are applied with a first voltage ELVDD and a second voltage ELVSS having a voltage level lower than that of the first voltage ELVDD. The first voltage ELVDD and the second voltage ELVSS are applied to light emitting elements, e.g., light emitting diodes, of the first and second pixels PX1 and PX2.

The first pixels PX1 receive the first data voltages through the first data lines DL1_1 to DL1_*n* in response to the first scan signals provided through the first scan lines SL1_1 to SL1_*m*. The first pixels PX1 display the first image corresponding to the first data voltages.

The second pixels PX2 receive the second data voltages through the second data lines DL2_1 to DL2_*n* in response to the second scan signals provided through the second scan lines SL2_1 to SL2_*m*. The second pixels PX2 display the second image corresponding to the second data voltages.

Accordingly, in such an embodiment, the first pixels PX1 are driven independently of the second pixels PX2, and thus the images are respectively displayed on the front and rear surfaces of the display panel 110.

Figure 2:
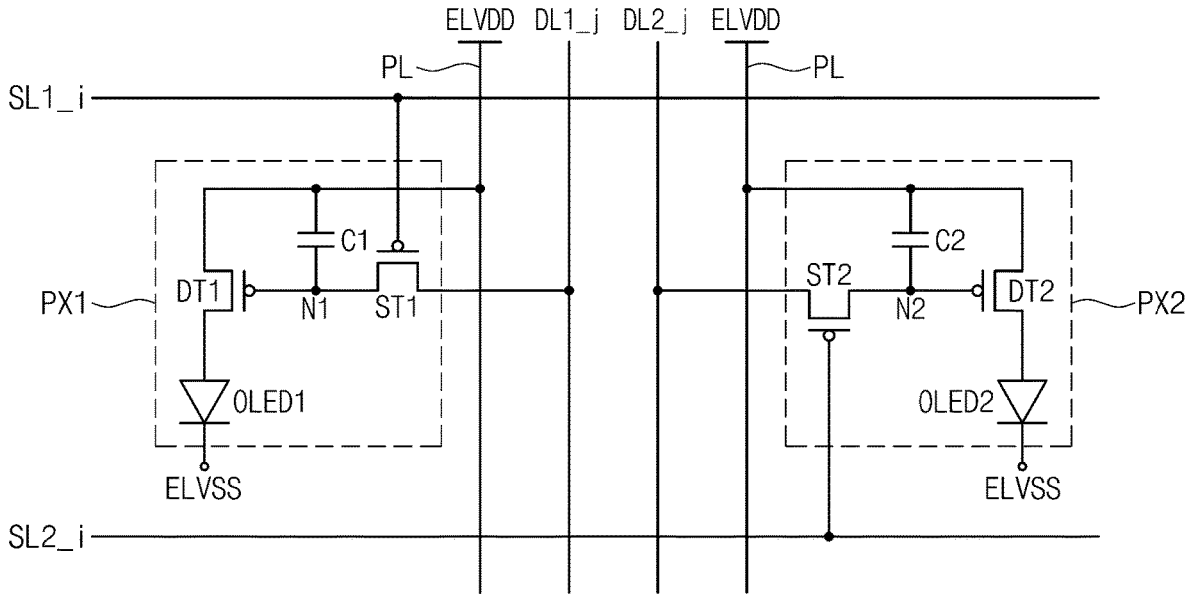
FIG. 2 is an equivalent circuit diagram showing an exemplary embodiment of first and second pixels shown in FIG. 1.

FIG. 2 is an equivalent circuit diagram showing an exemplary embodiment of the first and second pixels PX1 and PX2 shown in FIG. 1.

In an exemplary embodiment, the first pixels PX1 have the same circuit configuration and function as each other, and the second pixels PX2 have the same circuit configuration and function as each other. Therefore, for the convenience of illustration, FIG. 2 shows the equivalent circuit diagram of one first pixel PX1 and one second pixel PX2 disposed adjacent to the one first pixel PX1.

Referring to FIG. 2, in an exemplary embodiment, a first pixel PX1 includes a first light emitting diode OLED1 as a light emitting element thereof, a first driving element DT1, a first capacitance element C1, and a first switching element ST1. In such an embodiment, a second pixel PX2 includes a second light emitting diode OLED2 as a light emitting element thereof, a second driving element DT2, a second capacitance element C2, and a second switching element ST2.

In an exemplary embodiment, the first and second light emitting diodes OLED1 and OLED2 are organic light emitting diodes. In an exemplary embodiment, the first and second driving elements DT1 and DT2 and the first and second switching elements ST1 and ST2 are p-type transistors. In an alternative exemplary embodiment, the first and second driving elements DT1 and DT2 and the first and second switching elements ST1 and ST2 may be n-type transistors. The first and second capacitance elements C1 and C2 may be capacitors.

The first driving element DT1 may include an input terminal connected to a first electrode of the first capacitance element C1 and a power line PL, an output terminal connected to an input terminal (or an anode electrode) of the first light emitting diode OLED1, and a control terminal connected to an output terminal of the first switching element ST1.

A second electrode of the first capacitance element C1 is connected to the control terminal of the first driving element DT1. An output terminal (or a cathode electrode) of the first light emitting diode OLED1 receives the second voltage ELVSS. The power line PL receives the first voltage ELVDD.

The first switching element ST1 may include an input terminal connected to a corresponding first data line DL1_*j* of the first data lines DL1_1 to DL1_*n*, an output terminal connected to the control terminal of the first driving element DT1, and a control terminal connected to a corresponding first scan line SL1_*i* of the first scan lines SL1_1 to SL1_*m*. Here, each of "i" and "j" is a natural number.

The second driving element DT2 may include an input terminal connected to a first electrode of the second capacitance element C2 and the power line PL, an output terminal connected to an input terminal (or an anode electrode) of the second light emitting diode OLED1, and a control terminal connected to an output terminal of the second switching element ST2.

A second electrode of the second capacitance element C2 is connected to the control terminal of the second driving element DT2. An output terminal (or a cathode electrode) of the second light emitting diode OLED2 receives the second voltage ELVSS.

The second switching element ST2 may include an input terminal connected to a corresponding second data line DL2_j of the second data lines DL2_1 to DL2_n, an output terminal connected to the control terminal of the second driving element DT2, and a control terminal connected to a corresponding second scan line SL2_i of the second scan lines SL2_1 to SL2_m.

The scan signal is applied to the control terminal of the first switching element ST1 through the first scan line SL1_i. The first switching element ST1 is turned on in response to the scan signal.

The turned-on first switching element ST1 applies the first data voltage, which is provided through the first data line DL1_j, to a first node N1. The first capacitance element C1 is charged with the data voltage applied to the first node N1 and maintains the data voltage charged therein after the first switching element ST1 is turned off.

The first driving element DT1 is turned on in response to the data voltage charged in the first capacitance element C1. The first driving element DT1 is turned on until the data voltage charged in the first capacitance element C1 is completely discharged.

The turned-on first driving element DT1 receives the first voltage ELVDD through the power line PL. Accordingly, a current is provided to the first light emitting diode OLED1 through the first driving element DT1, and the first light emitting diode OLED1 thereby emits light. When the first light emitting diode OLED1 emits the light, the first image corresponding to the first data voltage is displayed.

The operation of the second pixel PX2 is substantially the same as that of the first pixel PX1 except that the second pixel PX2 receives the second data voltage through the second data line DL2_j. Therefore, any repetitive detailed descriptions of the operation of the second pixel PX will be omitted.

The second light emitting diode OLED2 emits light when the second pixel PX2 is operated, and thus the second image corresponding to the second data voltage is displayed.

The power line PL receives the first voltage ELVDD. In an exemplary embodiment, as shown in FIG. 2, two power lines PL are disposed between the first and second pixels PX1 and PX2, but not being limited thereto or thereby. In an alternative exemplary embodiment, a single power line PL may be used for the first and second pixels PX1 and PX2.

Figure 3:
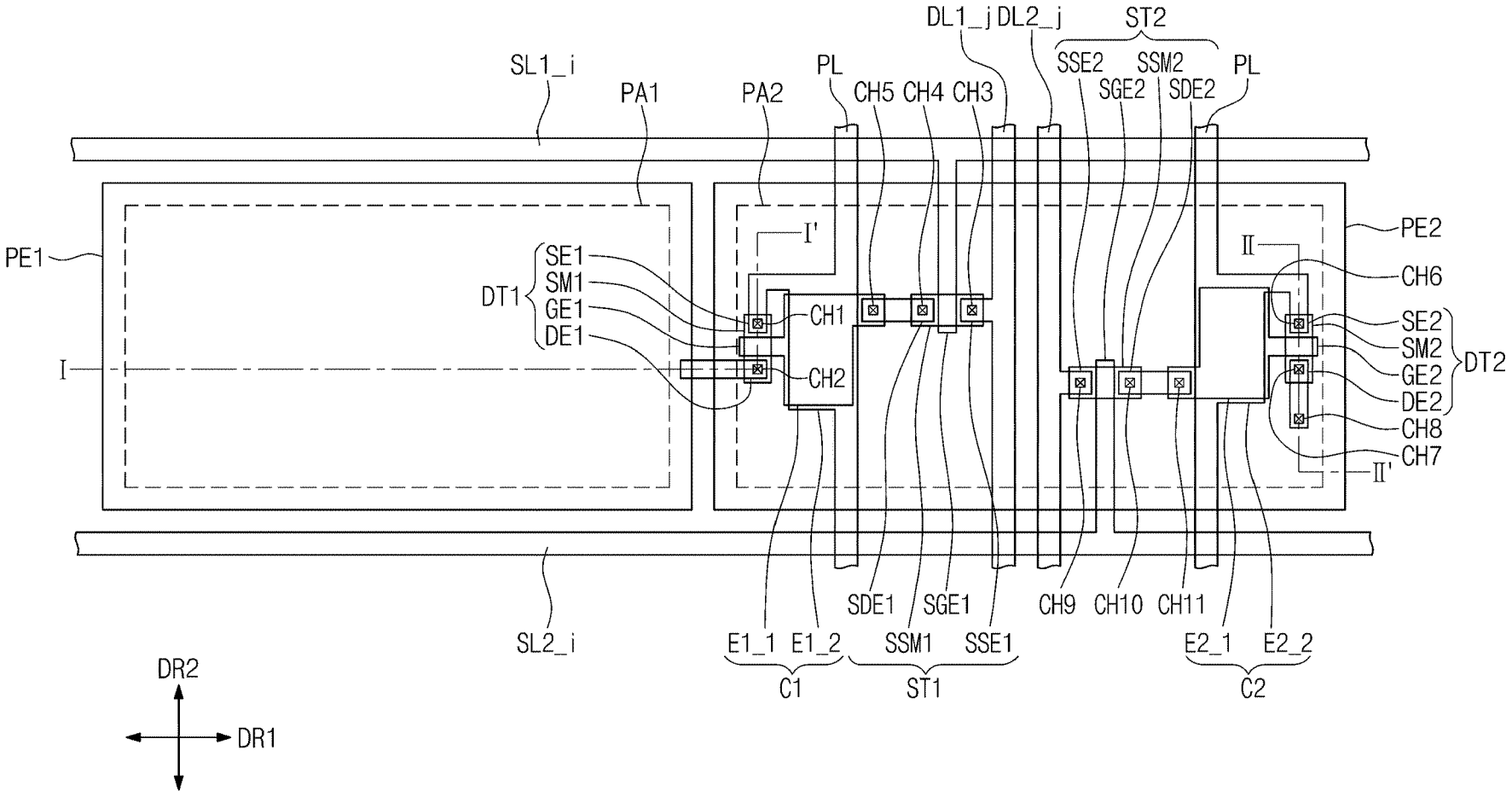
FIG. 3 is a top plan view showing an exemplary embodiment of the first and second pixels shown in FIG. 2.

FIG. 3 is a top plan view showing an exemplary embodiment of the first and second pixels PX1 and PX2 shown in FIG. 2.

Referring to FIG. 3, in an exemplary embodiment, the first scan line SL1_i extends in the first direction DR1 and is disposed at the upper portion of the row, in which the first and second pixels PX1 and PX2 are arranged. The first scan line SL1_i is connected to the first switching transistor ST1.

The second scan line SL2_i extends in the first direction DR1 and is disposed at the lower portion of the row, in which the first and second pixels PX1 and PX2 are arranged. The second scan line SL2_i is connected to the second switching transistor ST2.

The first and second data lines DL1_j and DL2_j and the power line PL extend in the second direction DR2 via the second pixel PX2. In an exemplary embodiment, the first pixel PX1 includes a first pixel area PA1 that displays the first image, and the second pixel PX2 includes a second pixel area PA2 that displays the second image.

The first and second pixel areas PA1 and PA2 of the first and second pixels PX1 and PX2 adjacent to each other are arranged in the first direction DR1. The first and second data lines DL1_j and DL2_j and the power line PL extend in the second direction DR2 via the second pixel area PA2.

In such an embodiment, as shown in FIG. 3, the first driving element DT1 and the first switching element ST1 of the first pixel PX1 are disposed to overlap the second pixel area PA2, and the second driving element DT2 and the second switching element ST2 of the second pixel PX2 are disposed to overlap the second pixel area PA2.

In such an embodiment, as shown in FIG. 3, the first pixel area PA1 is disposed to overlap a predetermined area of the first pixel electrode PE1 of the first light emitting diode OLED1. The second pixel area PA2 is disposed to overlap a predetermined area of the second pixel electrode PE2 of the second light emitting diode OLED2.

The first driving element DT1 includes a first gate electrode GE1 (or the control terminal) branched from (e.g., defined by a branched portion of) the first electrode E1_1 of the first capacitance element C1, a first source electrode SE1 (or the input electrode) branched from the power line PL, a first drain electrode DE1 (or the output terminal) disposed to be spaced apart from the first source electrode SE1, and a first semiconductor layer SM1 connected to the first source electrode SE1 and the first drain electrode DE1.

The first source electrode SE1 and the first drain electrode DE1 are disposed to allow the first gate electrode GE1 to be disposed between the first source electrode SE1 and the first drain electrode DE1. A predetermined area (e.g., a center portion) of the first semiconductor layer SM1 is disposed to overlap the first gate electrode GE1. Other areas (e.g., opposing side portions) of the first semiconductor layer SM1 are respectively connected to the first source electrode SE1 and the first drain electrode DE1 through first and second contact holes CH1 and CH2.

The first drain electrode DE1 extends and makes contact with a predetermined area of the first pixel electrode PE1, which is not overlapping the first pixel area PA1. The second electrode E1_2 of the first capacitance element C1 is branched from the power line PL.

The first switching element ST1 includes a first switching gate electrode SGE1 branched from the first scan line SL1_i, a first switching source electrode SSE1 branched from the first data line DL1_j, a first switching drain electrode SDE1 connected to the first electrode E1_1 of the first capacitance element C1, and a first switching semiconductor layer SSM1 connected to the first switching source electrode SSE1 and the first switching drain electrode SDE1.

The first switching source electrode SSE1 and the first switching drain electrode SDE1 are disposed to allow the first switching gate electrode SGE1 to be disposed between the first switching source electrode SSE1 and the first switching drain electrode SDE1. A center area of the first switching semiconductor layer SSM1 overlaps the first switching gate electrode SGE1.

Opposing side portions of the first switching semiconductor layer SSM1 are respectively connected to the first switching source electrode SSE1 and the first switching drain electrode SDE1 through third and fourth contact holes CH3 and CH4. The first switching drain electrode SDE1 extends and is connected to the second electrode E1_2 of the first capacitance element C1 through a fifth contact hole CH5.

The second driving element DT2 includes a second gate electrode GE2 (or the control terminal) branched from the first electrode E2_1 of the second capacitance element C2, a second source electrode SE2 (or the input electrode) branched from the power line PL, a second drain electrode DE2 (or the output terminal) disposed to be spaced apart from the second source electrode SE2, and a second semiconductor layer SM2 connected to the second source electrode SE2 and the second drain electrode DE2.

The second source electrode SE2 and the second drain electrode DE2 are disposed to allow the second gate electrode GE2 to be disposed between the second source electrode SE2 and the second drain electrode DE2. A center area of the second semiconductor layer SM2 is disposed to overlap the second gate electrode GE2. Opposing side areas of the second semiconductor layer SM2 are respectively connected to the second source electrode SE2 and the second drain electrode DE2 through sixth and seventh contact holes CH6 and CH7.

The second drain electrode DE2 extends and is connected to the second pixel electrode PE2 of the second light emitting diode OLED2 through an eighth hole CH8. The second electrode E2_2 of the second capacitance element C2 is branched from the power line PL.

The second switching element ST2 includes a second switching gate electrode SGE2 branched from the second scan line SL2_*i*, a second switching source electrode SSE2 branched from the second data line DL2_*j*, a second switching drain electrode SDE2 connected to the first electrode E2_1 of the second capacitance element C2, and a second switching semiconductor layer SSM2 connected to the second switching source electrode SSE2 and the second switching drain electrode SDE2.

The second switching source electrode SSE2 and the second switching drain electrode SDE2 are disposed to allow the second switching gate electrode SGE2 to be disposed between the second switching source electrode SSE2 and the second switching drain electrode SDE2. A center area of the second switching semiconductor layer SSM2 is disposed to overlap the second switching gate electrode SGE2.

Opposing side areas of the second switching semiconductor layer SSM2 are respectively connected to the second switching source electrode SSE2 and the second switching drain electrode SDE2 through ninth and tenth contact holes CH9 and CH10. The second switching drain electrode SDE2 extends and is connected to the second electrode E2_2 of the second capacitance element C2 through an eleventh contact hole CH11.

In such an embodiment, although not shown in figures, an insulating layer may be disposed between the first and second electrodes E1_1 and E1_2 of the first capacitance element C1, and between the first and second electrodes E2_1 and E2_2 of the second capacitance element C2.

The first and second semiconductor layers SM1 and SM2, and the first and second switching semiconductor layers SSM1 and SSM2 may include an inorganic semiconductor, e.g., amorphous silicon or polysilicon, an organic semiconductor, or an oxide semiconductor.

Figure 4:
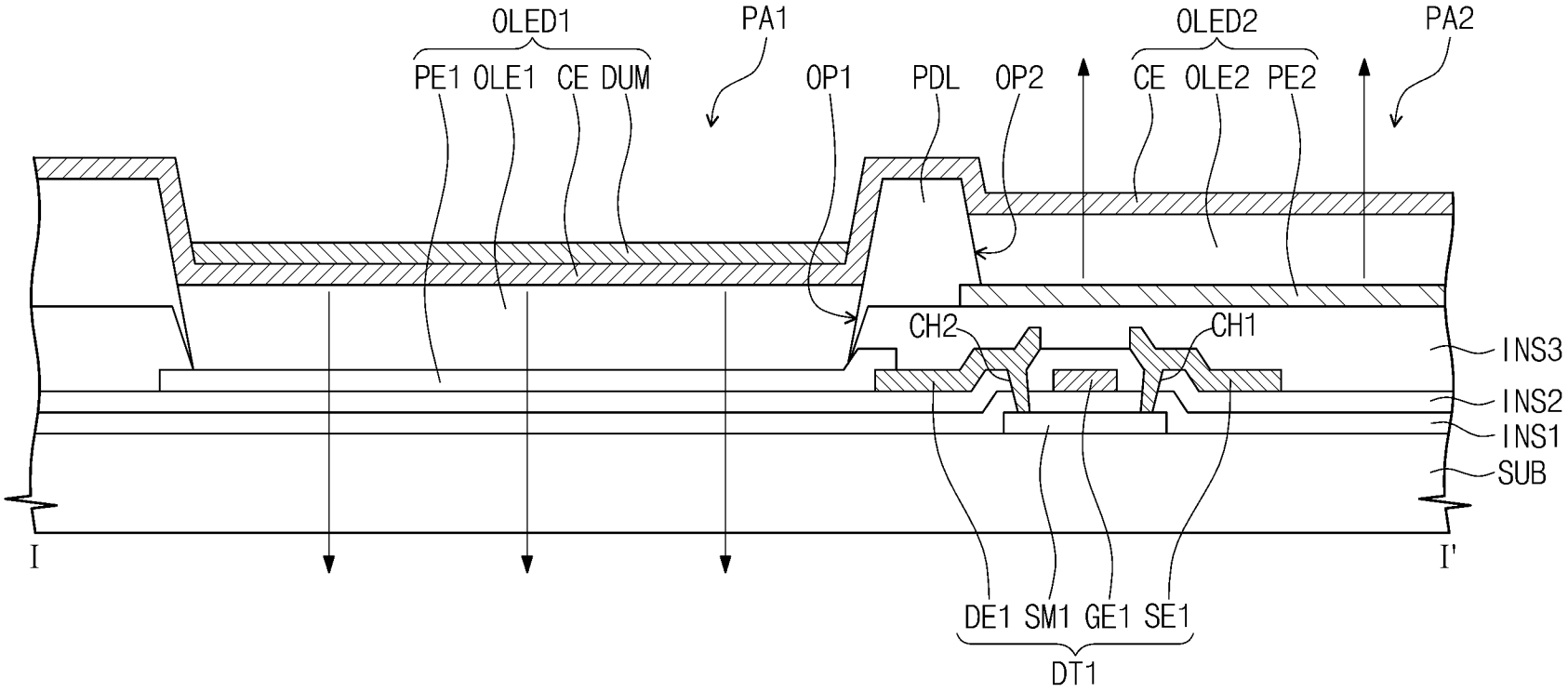
FIG. 4 is a cross-sectional view taken along line I-I' shown in FIG. 3.
Figure 5:
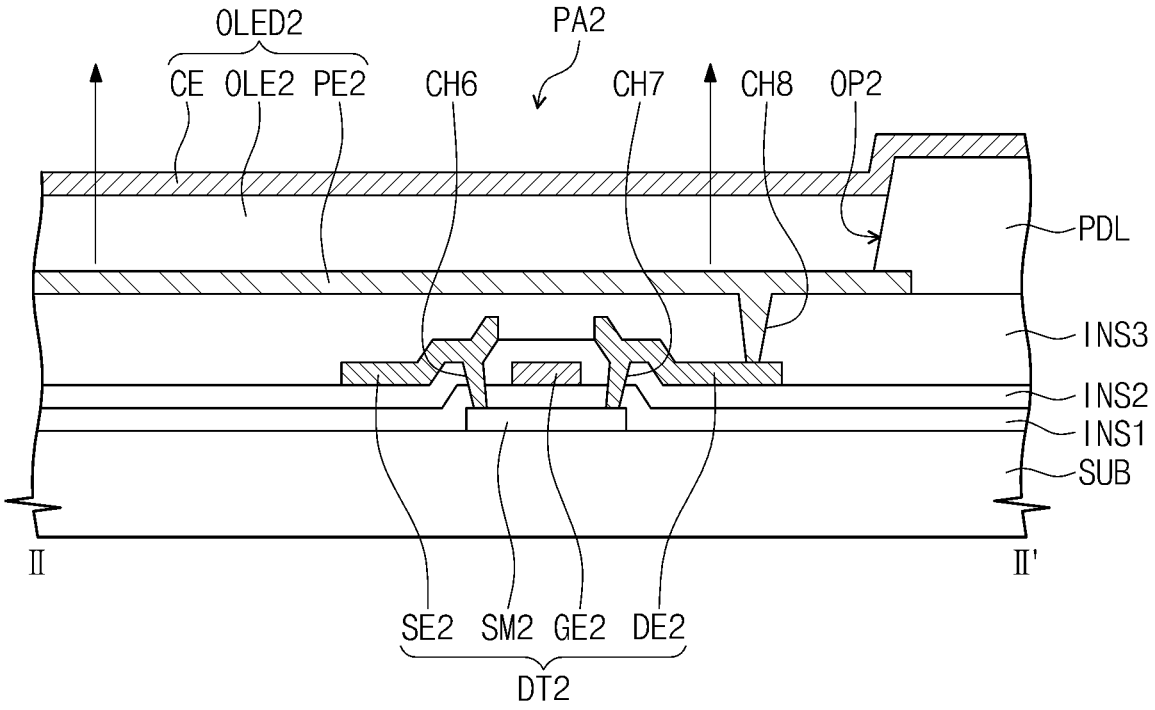
FIG. 5 is a cross-sectional view taken along line II-II' shown in FIG. 3.

FIG. 4 is a cross-sectional view taken along line I-I' shown in FIG. 3, and FIG. 5 is a cross-sectional view taken along line II-II' shown in FIG. 3.

Referring to FIGS. 4 and 5, in an exemplary embodiment, the first and second driving elements DT1 and DT2 and the first and second light emitting diodes OLED1 and OLED2 are disposed on a substrate SUB. The substrate SUB may be a transparent insulating substrate including glass, quartz, or ceramic, for example, or a transparent flexible substrate including a plastic, for example.

The first semiconductor layer SM1 of the first driving element DT1 and the second semiconductor layer SM2 of the second driving element DT2 are disposed on the substrate SUB. Although not shown in FIGS. 4 and 5, each of the first and second semiconductor layers SM1 and SM2 includes a source area, a drain area, and a channel area disposed between the source area and the drain area.

A first insulating layer INS1 is disposed on the substrate SUB to cover the first and second semiconductor layers SM1 and SM2. The first insulating layer INS1 may be, but not limited to, an inorganic insulating layer including an inorganic material.

The first gate electrode GE1 is disposed on the first insulating layer INS1 to overlap the first semiconductor layer SM1 of the first driving element DT1, and the second gate electrode GE2 is disposed on the first insulating layer INS1 to overlap the second semiconductor layer SM2 of the second driving element DT2.

The first gate electrode GE1 is disposed to overlap the channel area of the first semiconductor layer SM1, and the second gate electrode GE2 is disposed to overlap the channel area of the second semiconductor layer SM2.

A second insulating layer INS1 is disposed on the first insulating layer INS1 to cover the first and second gate electrodes GE1 and GE2. The second insulating layer INS2 may function as an inter-insulating layer. The second insulating layer INS2 may be, but not limited to, an inorganic insulating layer including an inorganic material.

The first source electrode SE1 and the first drain electrode DE1 of the first driving element DT1 are disposed on the second insulating layer INS2 and spaced apart from each other, and the second source electrode SE2 and the second drain electrode DE2 of the second driving element DT2 are disposed on the second insulating layer INS2 and spaced apart from each other.

The first source electrode SE1 is connected to the source area of the first semiconductor layer SM1 through the first contact hole CH1 defined or formed through the first and second insulating layer INS1 and INS2. The first drain electrode DE1 is connected to the drain area of the first semiconductor layer SM1 through the second contact hole CH2 defined or formed through the first and second insulating layer INS1 and INS2.

The first pixel electrode PE1 of the first light emitting diode OLED1 is disposed on the second insulating layer INS2. In an exemplary embodiment, as described above, the first pixel area PA1 overlaps the predetermined area of the first pixel electrode PE1. The first drain electrode DE1 extends and makes contact with a lower surface of the predetermined area of the first pixel electrode PE1, which does not overlap the first pixel area PA1.

The first pixel electrode PE1 may be a transparent electrode. In one exemplary embodiment, for example, the first electrode includes a transparent conductive material, e.g., indium tin oxide, indium zinc oxide, indium tin zinc oxide, etc. The first pixel electrode PE1 may be the anode electrode of the first light emitting diode OLED1.

The second source electrode SE2 is connected to the source area of the second semiconductor layer SM2 through the sixth contact hole CH6 defined or formed through the first and second insulating layers INS1 and INS2. The second drain electrode DE2 is connected to the drain area of the second semiconductor layer SM2 through the seventh contact hole CH7 defined or formed through the first and second insulating layers INS1 and INS2.

A third insulating layer INS3 is disposed on the second insulating layer INS2 to cover the first and second driving elements DT1 and DT2 in the second pixel area PA2. The third insulating layer INS3 may be, but not limited to, an organic insulating layer including the organic material.

A first opening OP1 is defined or formed through the third insulating layer INS3 to expose a predetermined area of the first pixel electrode PE1. The first opening OP1 corresponds to the first pixel area PA1. That is, the third insulating layer INS3 is not disposed in the first pixel area PA1 and is disposed on the second insulating layer INS3 except for the first pixel area PA1.

The second pixel electrode PE2 of the second light emitting diode OLED2 is disposed on the third insulating layer INS3. The second pixel electrode PE2 is connected to the second drain electrode DE2 of the second driving element DT2 through the eighth contact hole CH8 defined or formed through the third insulating layer INS3. The second pixel electrode PE2 may be a reflective electrode including a metal material. The second pixel electrode PE2 may be the anode electrode of the second light emitting diode OLED2.

A pixel definition layer PDL is disposed on the third insulating layer INS3. The first opening OP1 and a second opening OP2 are defined or formed through the pixel definition layer PDL to expose a predetermined area of the second pixel electrode PE2. The second opening OP2 corresponds to the second pixel area PA2.

In the first opening OP1, a first organic light emitting layer OLE1 of the first light emitting diode OLED1 is disposed on the first pixel electrode PE1. In the second opening OP2, a second organic light emitting layer OLE2 of the second light emitting diode OLED2 is disposed on the second pixel electrode PE2.

In an exemplary embodiment, each of the first and second organic light emitting layers OLE1 and OLE2 includes an organic material that generates a light having a red, green or blue color, but not being limited thereto or thereby. In an alternative exemplary embodiment, the first and second organic light emitting layers OLE1 and OLE2 may generate a white light by a combination of organic materials capable of emitting the red, green and blue lights, respectively.

Each of the first and second organic light emitting layers OLE1 and OLE2 may include a low molecular weight or high molecular weight organic material. Each of the first and second organic light emitting layers OLE1 and OLE2 has a multi-layer structure including a hole injection layer, a hole transport layer, an emission layer, an electron transport layer and an electron injection layer. In one exemplary embodiment, for example, the hole injection layer, the hole transport layer, the emission layer, the electron transport layer, and the electron injection layer are sequentially stacked on the first and second pixel electrodes PE1 and PE2.

A common electrode CE is disposed on the pixel definition layer PDL and the first and second organic light emitting layers OLE1 and OLE2. The common electrode CE may be the cathode electrode of the first and second light emitting diodes OLED1 and OLED2.

The common electrode CE includes the metal material. In an exemplary embodiment, the common electrode CE may have a thickness in a range of about 100 angstroms to about 200 angstroms. When the thickness of the common electrode CE is equal to or smaller than about 200 angstroms, the common electrode CE may effectively transmit the light.

A dummy electrode DUM is disposed on the common electrode CE in the first pixel area PA1. The dummy electrode DUM includes the metal material and has a thickness greater than that of the common electrode CE. Accordingly, a sum of the thickness of the common electrode CE and the thickness of the dummy electrode DUM in the first pixel area PA1 is greater than the thickness of the common electrode CE in the second pixel area PA2 by about 200 angstroms. In such an embodiment, the light is reflected by the common electrode CE and the dummy electrode DUM in the first pixel area.

The first light emitting diode OLED1 is collectively defined by the first pixel electrode PE1, the first organic light emitting layer OLE1, the common electrode CE and the dummy electrode DUM in the first pixel area PA1. The second light emitting diode OLED2 is collectively defined by the second pixel electrode PE2, the second organic light emitting layer OLE2 and the common electrode CE in the second pixel area PA2.

The first and second pixel electrodes PE1 and PE2 are positive electrodes that functions as hole injection electrode, and the common electrode CE is a negative electrode that functions as the electron injection electrode.

Due to the first driving element DT1, the first voltage ELVDD is applied to the first pixel electrode PE1, and the second voltage ELVSS is applied to the common electrode CE, such that holes and electrons injected into the first organic light emitting layer OLE1 are recombined in the first organic light emitting layer OLE1 to generate excitons, and the first organic light emitting diode OLED1 emits the light by the excitons that return to a ground state from an excited state.

The light emitted from the first light emitting diode OLED1 is reflected by the common electrode CE and the dummy electrode DUM in the first pixel area PA1 and transmits through the first pixel electrode PE1, and thus the light exits through the rear surface of the display panel 110. As a result, the first image is displayed on the rear surface of the display panel 110 as the rear image.

Due to the second driving element DT2, the first voltage ELVDD is applied to the second pixel electrode PE2 and the second voltage ELVSS is applied to the common electrode CE, and thus the second light emitting diode OLED2 emits the light.

The light emitted from the second light emitting diode OLED2 is reflected by the second pixel electrode PE2 and transmits the common electrode CE in the second pixel area PA2, and then the light exits through the front surface of the display panel 110. As a result, the second image is displayed on the front surface of the display panel 110 as the front image.

In an exemplary embodiment, the first and second driving elements DT1 and DT2 and the first and second switching devices ST1 and ST2 are disposed under the second light emitting diode OLED2 to overlap the second pixel area PA2. In such an embodiment, the first and second data lines DL1_*j* and DL2_*j* and the power line PL extend via the lower portion of the second light emitting diode OLED2 of the second pixel area PA2.

In an exemplary embodiment, the first and second driving elements DT1 and DT2, the first and second switching elements ST1 and ST2, the first and second data lines DL1_*j* and DL2_*j*, and the power line PL are disposed under the second light emitting diode OLED2, and the light emitted from the second light emitting diode OLED2 exits through the front surface of the display panel 110. Therefore, when the second image is displayed as the front image, a transmittance of the light may be effective prevented from being lowered due to the first and second driving elements DT1 and DT2, the first and second switching elements ST1 and ST2, the first and second data lines DL1_*j* and DL2_*j*, and the power line PL.

In such embodiment, since the first pixels PX1 and the second pixels PX2 are independently driven, the first and second images may be displayed together with each other as the rear and front images. Accordingly, exemplary embodiments of the display device 100 may display individual images on the rear and front sides thereof, respectively.

Although the exemplary embodiments of the invention have been described, it is understood that the invention should not be limited to these exemplary embodiments but various changes and modifications can be made by one ordinary skilled in the art within the spirit and scope of the invention as hereinafter claimed.

What is claimed is:

1. A display device comprising:

a plurality of first pixels which displays a rear image;

a plurality of second pixels which displays a front image;

a plurality of scan lines extending in a first direction and connected to the first and second pixels;

a plurality of data lines extending in a second direction crossing the first direction and connected to the first and second pixels; and a dummy electrode covering the first pixels, wherein the data lines overlap the second pixels, wherein each of the first pixels comprises:

a first light emitting diode disposed in a first pixel area;

a first driving element driving the first light emitting diode; and a first switching element switched to provide a first data voltage to the first driving element, wherein each of the second pixels comprises:

a second light emitting diode disposed in a second pixel area;

a second driving element driving the second light emitting diode; and a second switching element switched to provide a second data voltage to the second driving element, and wherein the first and second driving elements and the first and second switching elements are disposed to overlap the second pixel area in a plan view in a thickness direction.

2. The display device of claim 1, wherein each of the first pixels comprises a first pixel area on which the rear image is displayed, each of the second pixels comprises a second pixel area on which the front image is displayed, and the data lines extend via the second pixel area.

3. The display device of claim 1, wherein the scan lines comprise:

a plurality of first scan lines connected to the first pixels; and a plurality of second scan lines connected to the second pixels, and the data lines comprise:

a plurality of first data lines connected to the first pixels; and a plurality of second data lines connected to the second pixels.

4. The display device of claim 3, wherein the first pixels are alternately arranged with the second pixels in the first direction, and the first and second pixels are arranged in the second direction.

5. The display device of claim 4, wherein the first and second pixels are arranged substantially in a matrix form, each of the first scan lines is disposed at a upper portion of the first pixels arranged in a corresponding row and connected to the first pixels arranged in the corresponding row, and each of the second scan lines is disposed at a lower portion of the second pixels arranged in the corresponding row and connected to the second pixels arranged in the corresponding row.

6. The display device of claim 3, wherein the first switching element comprises a control terminal connected to a corresponding first scan line of the first scan lines, an input terminal connected to the first data line, and an output terminal, the first driving element comprises a control terminal connected to the output terminal of the first switching element, an input terminal connected to a power line, and an output terminal.

7. The display device of claim 6, wherein the second switching element comprises a control terminal connected to a corresponding second scan line of the second scan lines, an input terminal connected to the second data line, and the second driving element comprises a control terminal connected to the output terminal of the second switching element, an input terminal connected to the power line, and an output terminal.

8. The display device of claim 7, wherein the first and second data lines and the power line extend in the second direction via the second pixel area.

9. The display device of claim 7, wherein the first light emitting diode comprises:

a first pixel electrode connected to the output terminal of the first driving element;

a first organic light emitting layer disposed on the first pixel electrode;

a common electrode disposed on the first organic light emitting layer; and the dummy electrode disposed on the first organic light emitting layer, and the second light emitting diode comprises:

a second pixel electrode connected to the output terminal of the second driving element;

a second organic light emitting layer disposed on the second pixel electrode; and a common electrode disposed on the second organic light emitting layer.

10. The display device of claim 9, wherein the first pixel electrode is a transparent electrode comprising a transparent conductive material.

11. The display device of claim 9, wherein the second pixel electrode is a reflective electrode comprising a metal.

12. The display device of claim 9, wherein the common electrode and the dummy electrode of the first and second light emitting diodes comprise a metal.

13. The display device of claim 9, wherein the first and second data lines and the power line extend via the second organic light emitting layer, and the first and second driving elements and the first and second switching elements are disposed to overlap the second organic light emitting layer.

14. The display device of claim 9, further comprising:

a substrate on which the first and second driving elements are disposed;

an insulating layer disposed on the substrate to cover the first and second driving elements except for the first pixel area, wherein a first opening corresponding to the first pixel area is defined through the insulating layer; and a pixel definition layer disposed on the insulating layer, wherein the first opening and a second opening corresponding to the second pixel area are defined through the pixel definition layer, wherein the first pixel electrode is disposed on the substrate, the second pixel electrode is disposed on the insulating layer, the first opening exposes a predetermined area of the first pixel electrode, and the second opening exposes a predetermined area of the second pixel electrode.

15. The display device of claim 14, wherein the output terminal of the first driving element extends to make contact with a lower surface of the predetermined area of the first pixel electrode, which is not overlapping the first pixel area, and the output terminal of the second driving element is connected to the second pixel electrode through a contact hole defined through the insulating layer.

16. The display device of claim 3, wherein the first and second pixels are arranged substantially in a matrix form, the first pixels are alternately arranged with the second pixels in the second direction, the first and second pixels are arranged in the first direction, and each of the first scan lines and each of the second scan lines are disposed between the first pixels arranged in a corresponding row and the second pixels arranged in a next row of the corresponding row.

17. The display device of claim 1, further comprising:

a first scan driver which applies first scan signals to the first pixels through the scan lines;

a second scan driver which applies second scan signals to the second pixels through the scan lines;

a first data driver which applies first data voltages to the first pixels through the data lines; and a second data driver which applies second data voltages to the second pixels through the data lines.

18. The display device of claim 17, wherein the first pixels receive the first data voltages in response to the first scan signals and display the rear image using the first data voltages.

19. The display device of claim 17, wherein the second pixels receive the second data voltages in response to the second scan signals and display the front image using the second data voltages.

* * * * *